US010753712B1

(12) United States Patent
Foltz et al.

(10) Patent No.: US 10,753,712 B1
(45) Date of Patent: Aug. 25, 2020

(54) EXTRACTION SYSTEM FOR UNDERGROUND THREATS

(71) Applicant: The United States of America as Represented by the Secretary of the Navy, Indian Head, MD (US)

(72) Inventors: Lee Foltz, Indian Head, MD (US); George Torres, Hughesville, MD (US); Jim Wade, Waldorf, MD (US); Dan McCarthy, LaPlata, MD (US); Mike Sharp, King George, VA (US); Lonnie Frericks, King George, VA (US); Mike Shattuck, Port Royal, VA (US); Dennis Askin, King George, VA (US); Angel Diaz, Indian Head, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/602,048

(22) Filed: Jul. 29, 2019

(51) Int. Cl.
*F42B 3/08* (2006.01)
*F42B 3/22* (2006.01)
*F42B 1/036* (2006.01)

(52) U.S. Cl.
CPC ..... *F42B 1/036* (2013.01); *F42B 3/08* (2013.01); *F42B 3/22* (2013.01)

(58) Field of Classification Search
CPC ..... F42B 1/02; F42B 3/08; F42B 3/22; F42B 12/16; F42B 12/18; F42B 33/06; F42B 33/067; F41H 11/12; F41H 11/13–32
See application file for complete search history.

(56) References Cited

U.S. PATENT DOCUMENTS 3,358,780 A * 12/1967 Venghiattis ..... F42B 12/18 175/4.5
3,750,582 A * 8/1973 Kintish ..... F42B 12/18 102/476
4,004,515 A * 1/1977 Mallory ..... F42B 12/18 102/308
4,776,255 A 10/1988 Smith
5,099,747 A 3/1992 Smith
5,223,666 A * 6/1993 Delaney, Jr. ..... F41H 11/12 102/306
5,936,184 A * 8/1999 Majerus ..... F42B 3/08 102/306
5,979,290 A 11/1999 Simoeone
5,979,363 A 11/1999 Neff et al.
6,298,763 B1 * 10/2001 Greenfield ..... F41H 11/12 102/402

(Continued)

*Primary Examiner* — Gabriel J. Klein
(74) *Attorney, Agent, or Firm* — Fredric J. Zimmerman

(57) ABSTRACT

A system for extracting threats buried underground includes a housing, a shaped charge coupled to the housing at one end, and an explosive projectile disposed in the housing and spaced-apart from the shaped charge. The explosive projectile includes an open-ended pipe, a detonation line wrapped about the pipe and extending away therefrom and through the housing, an explosive material disposed about and in contact with the detonation line wrapped about the pipe. The explosive projectile also includes a first donut-shaped plate at one end of the pipe, a second donut-shaped plate at another end of the pipe, and a third donut-shaped plate coupled to and spaced-apart from the second donut-shaped plate. A flow path extends through the plates and the pipe.

18 Claims, 2 Drawing Sheets

(56) References Cited

U.S. PATENT DOCUMENTS

| | | | | |
|---|---|---|---|---|
| 6,494,139 | B1 * | 12/2002 | Powell | F42B 1/02 102/310 |
| 6,546,838 | B2 * | 4/2003 | Zavitsanos | C06B 33/00 102/364 |
| 6,883,414 | B2 * | 4/2005 | Lowery | F41H 11/20 102/403 |
| 9,157,705 | B1 * | 10/2015 | Majerus | F41H 11/12 |
| 10,365,073 | B1 * | 7/2019 | Foltz | F42C 19/0846 |
| 2014/0238222 | A1 * | 8/2014 | McKay | F41H 11/12 89/1.13 |

* cited by examiner

EXTRACTION SYSTEM FOR UNDERGROUND THREATS

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to explosive charges, and more particularly to an explosive system for extracting underground threats.

BACKGROUND OF THE INVENTION

Ordnance or other threats buried underground pose a threat to military personnel and civilians. In an effort to analyze how some underground ordnance is constructed, it is important to extract the ordnance or threat without it exploding or being activated. Currently, underground threats are removed by manually digging around the threat device, and then manually extracting the threat device by pulling on a line attached to the threat device. This approach is inefficient and exposes operations personnel to potential significant injury.

SUMMARY OF THE INVENTION

Accordingly, it is an object of the present invention to provide an apparatus for the removal or extraction of an underground threat.

Another object of the present invention is to provide an apparatus that can be used to extract a threat buried underground without any manual digging or manual manipulation of the threat and without any sympathetic initiation of the threat.

Still another object of the present invention is to provide an apparatus that can be used to extract a threat buried underground without endangering operations personnel prior to or during a threat extraction operation.

Other objects and advantages of the present invention will become more obvious hereinafter in the specification and drawings.

In accordance with the present invention, a system for extracting threats buried underground is provided. The system includes a housing, a shaped charge coupled to the housing at one end thereof, and an explosive projectile disposed in the housing and spaced-apart from the shaped charge. The explosive projectile includes an open-ended pipe, a detonation line wrapped about the pipe and extending away therefrom and through the housing, an explosive material disposed about and in contact with the detonation line wrapped about the pipe, a first donut-shaped plate at one end of the pipe, a second donut-shaped plate at another end of the pipe, and a third donut-shaped plate coupled to and spaced-apart from the second donut-shaped plate. A flow path extends through the third donut-shaped plate, the second donut-shaped plate, the pipe, and the first donut-shaped plate.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
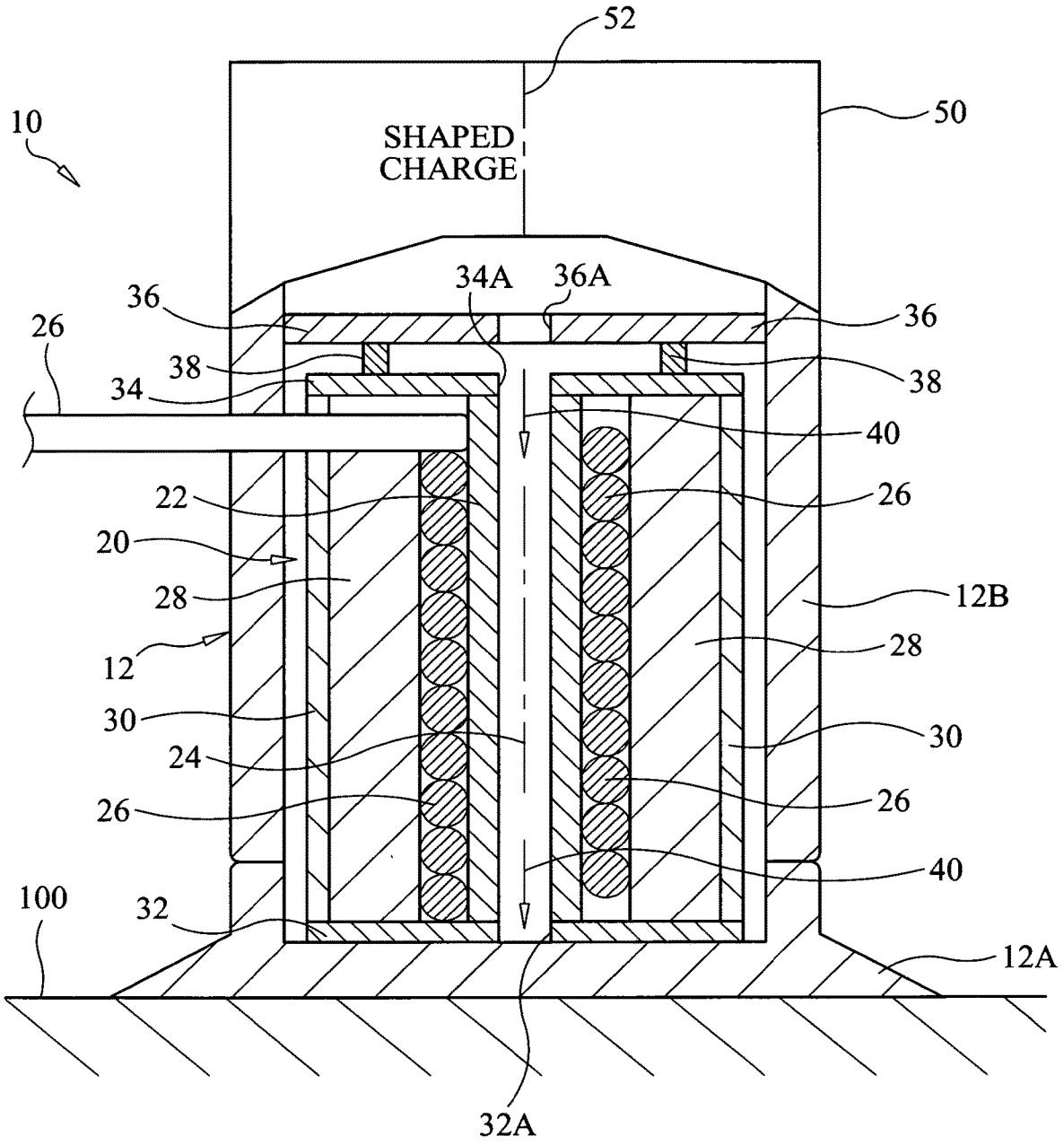
FIG. 1 is a cross-sectional view of a system for extracting an underground threat in accordance with an exemplary embodiment of the present invention.

Referring now to drawings and more particularly to FIG. 1, a system for extracting an underground threat in accordance with an exemplary embodiment of the present invention is shown in cross-section and is referenced generally by numeral 10. Extraction system 10 is designed to be placed directly on a ground surface 100 and remotely detonated. Extraction system 10 may be fully assembled in a factory environment or could be configured for assembly in a field environment just prior to use without departing from the scope of the present invention.

Extraction system 10 includes an outer housing 12 that may be a monolithic structure or an assembled structure without departing from the scope of the present invention. Housing 12 may be made from a lightweight and inexpensive material such as a plastic material. Housing 12 includes a base portion 12A and a body portion 12B that may be separate/assembled pieces or integrated with one another without departing from the scope of the present invention. Base portion 12A is configured for stable placement on ground surface 100. Base portion 12A may be solid (as shown) or hollow, and may be sealed or open without departing from the scope of the present invention. Body portion 12B extends from base portion 12A to house and/or support the energetic components of extraction system 10. By way of example, body portion 12B can be a hollow cylindrical tube.

Disposed in one end of body portion 12B is an explosive projectile 20 that is driven beneath ground surface 100 and into a bore hole (not shown) prior to being detonated as will be explained further below. The motive force for driving explosive projectile 20 beneath ground surface 100 is supplied by a shaped charge 50 coupled to the end of body portion 12B located furthest from base portion 12A. In the illustrated operational position of system 10, shaped charge 50 is atop of housing 12.

Shaped charge 50 can be realized by a variety of shaped charge designs without departing from the scope of the present invention. In general and as is understood in the art, shaped charge 50 generates a molten jet (not shown) and explosive pressure upon detonation with the molten jet being directed along the shaped charge's central axis 52 and into housing 12. By way of example, shaped charge 50 may be configured as the shaped charge disclosed in U.S. patent application Ser. No. 16/501,559, filed May 1, 2019, the entire contents of which are hereby incorporated by reference.

Explosive projectile 20 is axially spaced-apart from shaped charge 50. Projectile 20 includes an open-ended pipe 22 disposed along the central longitudinal axis (indicated by dashed line 24) of projectile 20. The configuration and positioning of projectile 20 in housing 12 is such that central axis 24 is aligned with central axis 52 of shaped charge 50. Pipe 22 is generally a straight and rigid pipe that is generally made of metal. Wrapped or coiled about pipe 22 is a detonation cord or line 26 that is long enough to be dressed out of housing 12 for ultimate coupling to a detonator (not shown) located at a safe stand-off distance from extraction system 10. A tubular arrangement of explosive material 28 is disposed (e.g., packed) all around the portion of detonation line 26 that is wrapped about pipe 22. Although not required for operational purposes, the outer surface of explosive material 28 may be covered by a protective sleeve 30 such as a wrapping of tape of flexible plastic.

The axial ends of projectile 20 are capped by rigid (e.g., metal) donut-shaped plates. More specifically, a first donut-shaped plate 32 is located at one end of pipe 22, a second donut-shaped plate 34 is located at the other end of pipe 22, and a third donut-shaped plate 36 is coupled to and spaced apart from plate 34 by spacers 38. Attachment of plates 32, 34 and 36 in this configuration may be accomplished in a variety of ways without departing from the scope of the present invention. For example, plates 32 and 34 could be rigidly coupled to the ends of pipe 22, and plate 36 could be rigidly coupled to plate 34 using spacers 38.

The donut-shaped configuration of each plate 32, 34 and 36 provides a corresponding central opening 32A, 34A and 36A, respectively, aligned with central axis 24 of pipe 22. In this way, a linear flow path is defined through projectile 20 as indicated by arrows 40, where linear flow path 40 aligns with the shaped charge's central axis 52 and the pipe's central axis 24.

Figure 2:
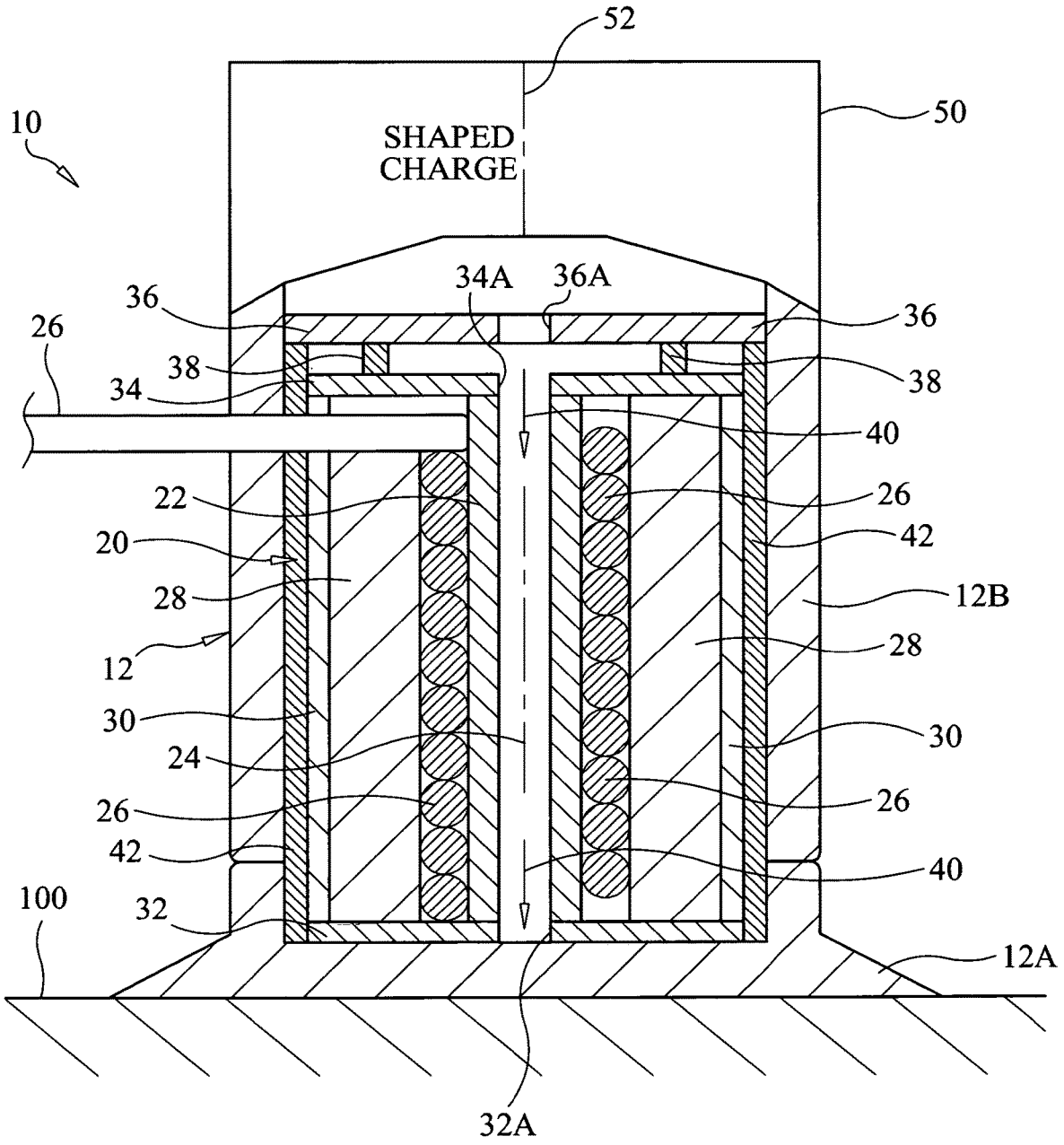
FIG. 2 is a cross-sectional view of a system for extracting an underground threat in accordance with another exemplary embodiment of the present invention.

If necessary, the present invention can further include spacers to properly position projectile 20 in body portion 12B. For example, FIG. 2 illustrates the use of multiple spacers 42 disposed between the outer surface of projectile 20 and the inner surface of body portion 12B. The space between spacers 42 also may be used to assist with the dressing of detonation line 26 out of housing 12.

In operation, extraction system 10 is placed on ground surface 100 with base portion 12A resting on the ground near the area of a known buried threat. Shaped charge 50 is detonated and its generated molten jet (not shown) is driven along flow path 40 and through base portion 12A. The molten jet bores into the ground to thereby form a bore hole. The explosion forces released by shaped charge 50 impinge upon plate 36 to drive explosive projectile 20 into the created bore hole. Since plate 36 receives the brunt of the explosive forces, the shape integrity of plate 34 and the rest of projectile 20 is preserved as projectile 20 is driven into the bore hole. As projectile 20 follows the molten jet into the bore hole formed by the molten jet, the portion of detonation line 26 that extends from housing 12 is pulled into the bore hole. Since the detonator (not shown), which will be coupled to detonation line 26 outside of housing 12, is isolated from extraction system 10, premature or sympathetic detonation of explosive material 28 is prevented.

In general, the explosive forces generated when explosive material 28 is detonated (within a bore hole in the ground) act on a buried threat to raise the threat up out of the ground. More specifically, a pressure wave moves towards a buried threat after explosive material 28 is initiated. The pressure wave includes a shock front followed by a slower particle wave that impacts the buried threat and accelerates the surrounding soil in an upward direction. Expanding gases produced from the chemical reaction of the explosive also contribute to an upward motion of the buried threat.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A system for extracting threats buried underground, comprising:
- a housing;
- a shaped charge being coupled to said housing at one end thereof; and
- an explosive projectile being disposed in said housing and spaced-apart from said shaped charge,
- wherein said explosive projectile includes
- an open-ended pipe,
- a detonation line wrapped about said pipe and extending away therefrom and through said housing,
- an explosive material disposed about and in contact with said detonation line wrapped about said pipe,
- a first donut-shaped plate at one end of said pipe,
- a second donut-shaped plate at another end of said pipe, and
- a third donut-shaped plate coupled to and spaced-apart from said second donut-shaped plate, and
- wherein a flow path extends through said third donut-shaped plate, said second donut-shaped plate, said pipe, and said first donut-shaped plate.

2. The system as in claim 1, wherein said housing comprises a cylinder.

3. The system as in claim 1, wherein said flow path is linear.

4. The system as in claim 1, wherein said flow path is aligned with a central axis of said shaped charge.

5. The system as in claim 1, wherein said pipe comprises a straight metal pipe.

6. The system as in claim 1, further comprising spacers disposed between an inside surface of said housing and an outside surface of said explosive projectile, wherein said flow path is aligned with a central axis of said shaped charge.

7. The system as in claim 1, further comprising a base coupled to another end of said housing, wherein said base adapted to rest on a ground surface, wherein said housing extends upwards from the ground surface, and wherein said shaped charge is atop said housing.

8. A system for extracting threats buried underground, comprising:
- a cylindrical housing;
- a shaped charge being coupled to said cylindrical housing at one end thereof; and
- a cylindrical explosive projectile being disposed in said cylindrical housing and spaced-apart from said shaped charge,
- wherein said cylindrical explosive projectile includes
- an open-ended cylindrical pipe,
- a detonation line wrapped about said cylindrical pipe and extending away therefrom and through said cylindrical housing, a cylindrical tube of explosive material disposed about and in contact with said detonation line wrapped about said cylindrical pipe, a first donut-shaped plate at one end of said cylindrical pipe, a second donut-shaped plate at another end of said cylindrical pipe, and a third donut-shaped plate coupled to and spaced-apart from said second donut-shaped plate, and wherein a flow path extends through said third donut-shaped plate, said second donut-shaped plate, said cylindrical pipe, and said first donut-shaped plate.

9. The system as in claim 8, wherein said flow path is linear.

10. The system as in claim 8, wherein said flow path is aligned with a central axis of said shaped charge.

11. The system as in claim 8, wherein said cylindrical pipe comprises a metal pipe.

12. The system as in claim 8, further comprising spacers disposed between an inside surface of said cylindrical housing and an outside surface of said cylindrical explosive projectile, wherein said flow path is aligned with a central axis of said shaped charge.

13. The system as in claim 8, further comprising a base coupled to another end of said cylindrical housing, said base adapted to rest on a ground surface, wherein said cylindrical housing extends upwards from the ground surface, and wherein said shaped charge is atop said cylindrical housing.

14. A system for extracting threats buried underground, comprising:

a housing;

a shaped charge being coupled to said housing at one end thereof;

an explosive projectile being disposed in said housing and spaced-apart from said shaped charge, wherein said explosive projectile includes an open-ended pipe, a detonation line wrapped about said pipe and extends away therefrom and through said housing, an explosive material disposed about and in contact with said detonation line wrapped about said pipe, a first donut-shaped plate at one end of said pipe, a second donut-shaped plate at another end of said pipe, and a third donut-shaped plate coupled to and spaced-apart from said second donut-shaped plate, and wherein a linear flow path extends through said third donut-shaped plate, said second donut-shaped plate, said pipe, and said first donut-shaped plate; and a base being coupled to another end of said housing, wherein said base is adapted to rest on a ground surface, wherein said housing extends upwards from the ground surface, and wherein said shaped charge is atop said housing.

15. The system as in claim 14, wherein said housing comprises a cylinder.

16. The system as in claim 14, wherein said linear flow path is aligned with a central axis of said shaped charge.

17. The system as in claim 14, wherein said pipe comprises a straight metal pipe.

18. The system as in claim 14, further comprising spacers being disposed between an inside surface of said housing and an outside surface of said explosive projectile, wherein said linear flow path is aligned with a central axis of said shaped charge.

* * * * *